United States Patent [19]

Morell et al.

[11] Patent Number: 4,633,599

[45] Date of Patent: Jan. 6, 1987

[54] SKI BOOT

[75] Inventors: Joseph Morell, Annecy; Louis Benoit, Frangy; Maurice Bonnet, Rumilly, all of France

[73] Assignee: Salomon S. A., Annecy, France

[21] Appl. No.: 767,391

[22] Filed: Aug. 19, 1985

[30] Foreign Application Priority Data

Aug. 17, 1984 [FR] France ..... 84 12911

[51] Int. Cl.[4] ..... A43B 11/00; A43B 5/04

[52] U.S. Cl. ..... 36/50; 36/117; 36/120; 24/68 SK; 24/71.2

[58] Field of Search ..... 36/117–121, 36/50; 24/68 SK, 71.2, 68 B, 69 SK

[56] References Cited

U.S. PATENT DOCUMENTS

| | | | |
|---|---|---|---|
| 2,586,048 | 2/1952 | Hyatt | 24/71.2 |
| 3,808,644 | 5/1974 | Schoch | 36/50 X |
| 4,433,456 | 2/1984 | Baggio | 36/50 X |

FOREIGN PATENT DOCUMENTS

| | | | |
|---|---|---|---|
| 0099504 | 2/1984 | European Pat. Off. | 36/117 |
| 0132744 | 2/1985 | European Pat. Off. | 36/117 |
| 2341658 | 3/1974 | Fed. Rep. of Germany | 36/117 |
| 2900077 | 7/1980 | Fed. Rep. of Germany | 36/50 |

*Primary Examiner*—James Kee Chi

*Attorney, Agent, or Firm*—Pollock, Vande Sande & Priddy

[57] ABSTRACT

A downhill ski boot (1), the upper (3) of which has a front collar (4) and a rear cap (5) placed mutually around an axis (6). The collar (4) and the cap (5) are kept in a position pressing against the skier's leg by tension on a cable (8) which is anchored by one end on the collar (4) or the cap (5) and on its other end on means (19) which allow traction to be applied to it by winding under the action of the elastic solicitation means for the reel in a direction winding up the flexible cable (8) and under the action of manual pulling means (81) allowing additional windup for adjustment of the pressure applied to the skier's leg. This arrangement permits a precise adaptation of the upper (3) of the boot for any leg conformation.

12 Claims, 13 Drawing Figures

SKI BOOT

FIELD OF THE INVENTION

This invention pertains to a ski boot, more particularly to a downhill ski boot, of the type which includes:

two rigid upper elements forming a front element or collar and a rear element or cap, arranged mutually in a lower area of of the upper to allow the possibility of maneuvering between a position of relative and opening and closing of the upper, and notably, to allow variable support positions of the two elements against the skier's leg, intermediate between said opening and closing positions, and releasable locking means to keep the upper elements in the position pressing against the leg and, when desired, to allow their passage into the open position, said locking means for this purpose including at least one flexible cable, relatively inextensible, in functional connection with at least a first of the elements in its upper area, and means of traction of the flexible cable, held by the second of the elements.

The boot will be considered in its normal use position and in reference to a normal forward movement position, with respect to any definition of relative positioning.

BACKGROUND OF THE INVENTION

A ski boot of this type is described, for example, in French Patent Application No. 83 20413, which recommends an anchor for the flexible cable through its two end zones, respectively on both sides of the collar and a bypass of the cap through the rear, through an intermediate zone of the flexible cable between the two aforementioned end areas. According to this document, behind the cap and on it is placed a lever connected with the intermediate area of the flexible cable to allow either pressure of the two upper elements against the skier's leg, with the application of pressure on the latter by tightening the flexible cable, or a free passage of the two elements to their open position to allow the disengagement of the foot, by release of the flexible cable.

Such a mode of tightening or loosening the flexible cable requires at least two deviation zones for the latter to be provided on the cap, respectively on both sides of the lever.

In addition, the necessary adaptation of the pressing position on a skier's leg to the measurements of the latter if one wishes to avoid either an excessive compression of the leg between the collar and the cap, or a too-loose fit of the upper around the leg, requires the provision of a possibility for adjusting the relative mutual anchoring position of the flexible cable and the collar. For this purpose, the aforementioned application proposes means allowing the fixing of the end zones of the flexible cable at several respective points on the collar, resulting in a limited number of defined cable positions corresponding to well-determined conformations to the skier's legs, but among which none may be completely satisfactory for other conformations.

OBJECT AND SUMMARY OF THE INVENTION

The purpose of this invention is to correct these drawbacks and, for this purpose, in a boot of the aforementioned type, the invention provides the achievement of the means of traction on the flexible connection in a form including:

a winding reel for the flexible cable, one zone of which is integral with a zone of the reel, means, carried by the second upper element, for defining a rotational axis of the spool with respect to this second element, means for elastic solicitation of the spool in a predetermined rotational direction around said axis, corresponding to a windup of the flexible cable, to elastically solicit the upper elements towards the closing position of the rod, means for manual pulling of the reel in said direction, to allow additional winding of the flexible cable on the reel when the upper elements occupy a position pressing against a skier's leg, means for temporary immobilization of the reel upon rotation in the direction opposite to said predetermined direction.

Advantageously, the means of traction on the flexible cable are grouped in a housing solid with the second upper element and covered by a button for actuation of the manual pulling of the reel.

Thus, in compact and esthetic form, the means of traction on the flexible cable allow an adaptation of the pressing position of the two upper elements against the skier's leg and conformation thereto. The pressing position can be chosen as desired, in a continuous manner, between the open and closed positions; the upper elements are assumed to initially occupy their open position, the boot is put on by placing the foot in the boot, then by allowing the upper elements to move into position under the action of the elastic solicitation of the reel, and finally, by adjusting the tightening of the elements against the leg by manual action on the manual reel pulling means. Thus, the pressing position against the skier's leg which is best adapted to the conformation to such leg is obtained, easily and rapidly, in a first automatic approach under the action of the means of elastic solicitation of the reel, followed by a manual intervention which presents little constraint, since the adjustment of the tightening of the upper elements against the leg assumes a low rotation amplitude for the reel, and the boot is put on in a particularly convenient and rapid manner.

BRIEF DESCRIPTION OF THE DRAWINGS

Other characteristics and advantages for the invention will emerge from the description below, concerning several embodiments, as well as the attached drawings which are an integral part of this description.

DETAILED DESCRIPTION

Figure 4:
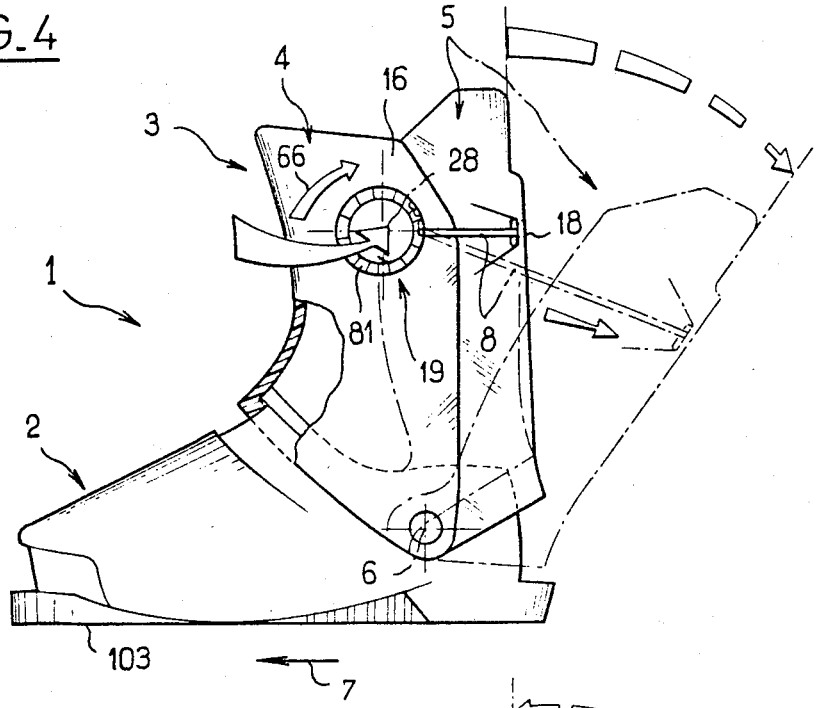
FIGS. 4 and 5 illustrate a first embodiment for the assembly of the releasable locking means which activate the means of traction on the flexible cable illustrated in FIGS. 1 to 3, respectively in closed position and in open position of the upper.
Figure 5:
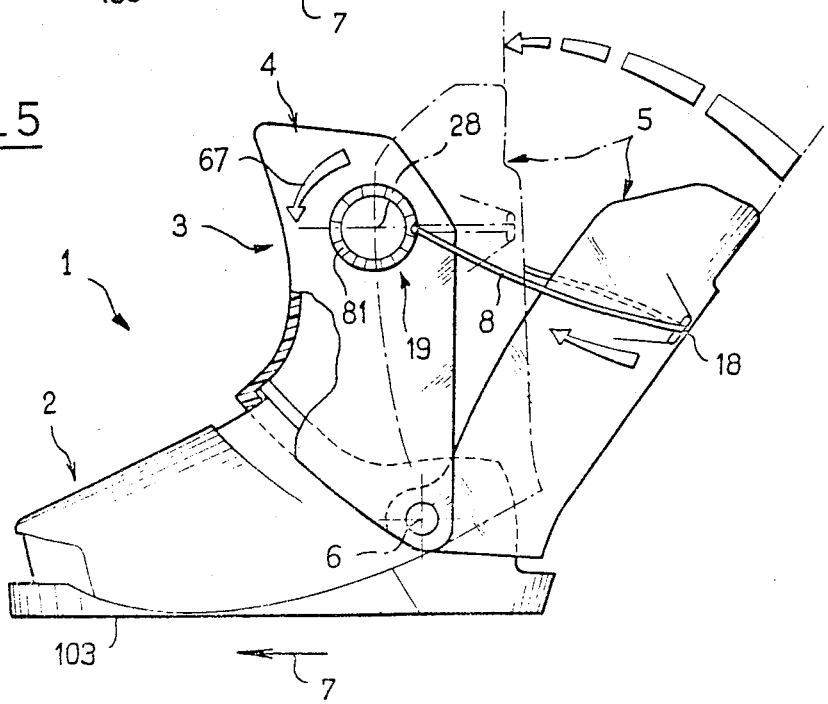
Figure 6:
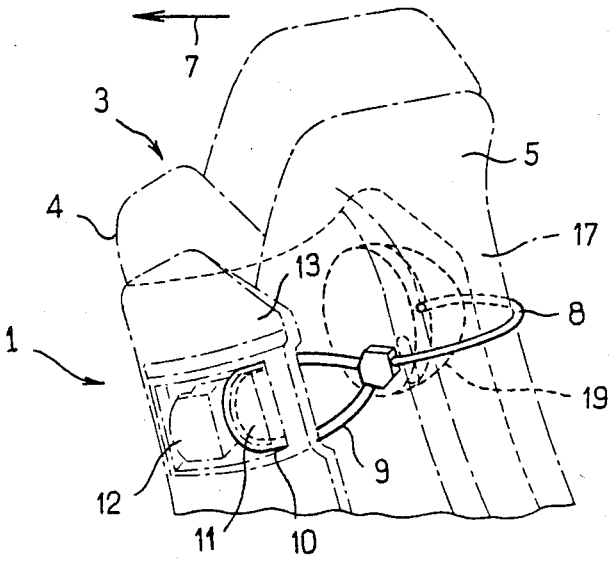
FIG. 6 illustrates a detail of the assembly of the flexible cable.

FIGS. 4 to 6 show a downhill ski boot 1, which includes in a manner known per se, a lower rigid shell 2 defining a sole 103 and destined to accommodate the foot on the inside, and an upper 3 projecting upward above the shell 2 to receive the base of the skier's leg. In an equally known manner, the upper 3 is comprised of two rigid elements, namely, a front element or collar 4 and a rear element or cap 5, arranged mutually in a lower area of the upper, around a transversal and horizontal axis 6 with respect to a forward moving direction 7, so that it can move between a relative open position, illustrated in broken lines in FIG. 4 and solid lines in FIG. 5, in which the collar 4 and the cap 5 are separated from each other in an upper area of the upper to allow the engagement or disengagement of the foot from the boot, and a relative closed position, illustrated in solid lines in FIG. 4 and in broken lines in FIG. 5, in which the collar 4 and the cap 5 are as close as possible to the upper part of the upper 3. The collar 4 and the cap 5 can also occupy any intermediate position between these two limit positions, by relative pivoting around the axis 6, to adapt against the base of the skier's leg, according to a pressure which can be selected by the skier. This intermediate position, essentially variable as a function of the conformation of the skier's leg and the pressure he considers most appropriate to ensure correct maintenance of the boot, as well as comfort in use, is not shown.

In a manner known per se and as illustrated, the collar 4 can be fixed with respect to the shell 2, in which case only the cap 5 pivots around the axis 6 both with respect to the collar 4 and with respect to the shell 2. However, the invention also extends to an assembly in which the collar 4 pivots around the axis 6 with respect to the shell 2.

These arrangements are known to those skilled in the art and will not be further described.

On the other hand, a description follows of the assembly mode for the releasable locking means provided, in this example in FIGS. 4 to 6, for retaining the collar 4 and the cap 5 in their relative position pressing against the skier's leg and allowing, when desired, their passage into the open position of the upper.

In this example, these means include a single, flexible cable 8, relatively inextensible with two ends, a first end 9 of which is formed into a loop 10 which can be anchored, at least against displacement towards the rear, on one of several hooks 11, 12, held in a solidary manner by the collar 4 in an upper lateral zone 13 thereof, near the rear limit of this zone 13, and the second end 14 of which is attached by any known means to a winding reel 15 which will be described below, and which is itself held by the upper lateral zone 16 of the collar 4 opposite the aforementioned zone 13, near the rear limit of this upper lateral zone 16. Between these two ends 9 and 14, the cable 8 bypasses towards the rear, i.e., through the outside of the upper an upper zone 17 of the cap which, advantageously, has, in this zone 17, towards the rear, a guidance tamisat 18 for the cable 8, sliding on itself, preventing a forward, rear, downward, upward movement of the cable 8 with respect to the cap 5.

The winding reel 15 is an integral part of the means of traction on the cable 8, which will now be described. Referring, for example, to FIG. 4, it will be noted that these means 19, the tamisat 18 and the hooks 11, 12 (visible only in FIG. 6) are located at a same medium level, in an upper zone of the upper, when the cap 5 and the collar 4 occupy their closed position.

The means 19 include a base plate 20 connected by any appropriate means, and, for example, by screwing (not shown), with the collar 4 in the upper lateral zone 16 thereof, on the exterior of the upper 3, such that the plate 20 has a plane side 25 in flush contact with the collar 4, approximately vertically and approximately parallel in the direction 7.

Parallel to the side 25 and in the direction of a distancing with respect to the collar 4, the base plate 20 has a second plane side 26 connected to the side 25 by a cylindrical edge 27 revolving around an axis 28 which is perpendicular to the sides 25 and 26, i.e., placed approximately horizontally and approximately perpendicular in the direction 7; the edge 27 defines the limits of the base plate 20 in the direction of radial distancing with respect to the axis 28.

Projecting on its side 26, the base plate 20 has a part 29 in the form of a sleeve, delimited in the direction of a distancing with respect to the axis 28 by a cylindrical side 30 revolving around this axis with a diameter which is slightly smaller than that of the edge 27, in the direction of approach with respect to the axis 28 by a side 31, which is also cylindrical, for revolving around this axis 28 with a diameter which is smaller than that of the side 30, and transversally with respect to the axis 28:

on one hand, through the side 25, that the side 31 rejoins through the base plate 20, defining a hole 32 therethrough on the other hand, through an annular plane side 33, perpendicular to the axis 28, and which connects the sides 31 and 30 with an orientation which is identical to that of side 26; side 30 connects side 33 to side 26 of the base plate 20.

The central protuberance 29 of the side 26 of the base plate 20 is housed within a housing 34, which is connected in a movable manner with the base plate 20, for example, by screwing through openings 21, 22, 23, 24 in the base plate and 35, 36, 37, 38 of the housing 34.

In flush contact with the side 26 in immediate proximity of the edge 27, the housing 34 has an annular plane side 39 perpendicular to the axis 28 and mutually joining two sides 40, 41 of the housing 34, these two sides 40 and 41 both being cylindrical, revolving around the axis 28. The side 40 is turned towards the axis 28 with a diameter which is slightly smaller than that of the edge 27 of the base plate 20 and greater than that of the side 30 of the protuberance 29, and connects the side 39 of the housing 34 to a side 42 of this housing 34, the side 42 of which is annular, flat, perpendicular to the axis 28, and of the same orientation as the side 39; on this side 42, projecting towards the base plate 20, on the inside of the side 40,. is placed a protuberance 43, which notably has, in the direction of a distancing with respect to the axis 28, a toothed side 44 of the axis 28, to which the side 42 connects the side 40 of the housing 34. Thus delimited by intersection with the side 42 in the direction of an extension with respect to the base plate 20, parallel to the axis 28, the side 44 is delimited in the direction of approach with respect to the plate 20 by connection with an annular plane side 45, which is perpendicular to the axis 28. The respective lengths of sides 30 and 44 parallel to the axis 28 are such that when added together, they are less than the length of the side 40, parallel to this axis 28, such that the sides 45 and 33 are turned towards each other while leaving a space 46 between them. In the direction of a radial approach with respect to the axis 28, the side 45 connects the side 44 to a cylindrical side 46 which revolves around the axis 28 towards which this side 46 is turned; this side 46 thus joins, parallel to the axis 28, the side 45 to a side 47, which is annular, planar, perpendicular to the axis 28, and has an orientation opposite of that of side 42, which side 47 defines, with the side 42, a flat wall or bottom 48 of the housing 34. In the direction of a radial distancing with respect to the axis 28, the side 47 connects the side 46 to a cylindrical side 49 revolving around the axis 28 with an intermediate diameter between that of sides 40 and 41, a truncated conical fillet 50 for revolving around the axis 28 being placed at the intersection of sides 47 and 49. The side 49 thus connects, in the direction of an approach with respect to the side 39, parallel to the axis 28, the fillet 50 connecting the side 47 to an annular planar side 51, perpendicular to the axis 28 and oriented in the same manner as the side 47, i.e., opposite side 39, and this side 51 itself connects side 49 to side 41. Sides 40, on the one hand, 49 and 41 on the other hand, define between them a peripheral wall 52 of the housing 34, which, through this peripheral wall 52 and through its bottom wall 48 internally delimits, with the base plate 20, a space 53 inside which is housed notably the reel 15 for winding the cable 8 which penetrates to the inside of this space 53, approximately radially with respect to the axis 28, via one (54) of the two openings 54, 55 which are placed radially, with respect to the axis 28, in the peripheral wall 52 of the housing 34 in two zones which are diametrically opposed to it, between sides 51 and 47 and approximately at the midpoint of the side 40 following the axis 28, the side 51 being closer to the side 39 than to the side 42.

The reel 15 has the general shape of a grooved pulley, delimited toward the axis 28 by a cylindrical side 56 for revolving around an axis 157 parallel to the axis 28 but shifted with respect to the latter with a diameter greater than the maximum diameter of the side 44 of the protuberance 43 of the side 42 of the housing 34 and the diameter of the side 30 of the protuberance 29 of the side 26 of the base plate 20, and a length, parallel to the axis 28 or the axis 157, more or less equal to the distance separating, parallel to either of the axes, the side 33 of the protuberance 29 and the side 42 of the housing 34.

Respectively towards the side 42 of the housing 34 and towards the side 26 of the base plate 20, the side 56 of the reel 15 is adjacent to two sides 57 and 58 of the reel, which are annular, planar, and revolving around the axis 157 to which they are perpendicular. The first 157 of these sides 57, 58 is in sliding contact, flush, with the side 42 of the housing 34, while the second (58) of these sides 57, 58 is more or less coplanar with the side 33 of the protuberance 29 of the side 26 of the base plate 20, and turned towards this side 26, depending on the maintenance, between these sides 58 and 26, of a clearance 59 inside of which is housed a spiral spring 60, wound around the side 30 of the protuberance 29 of the side 26 of the base plate 20 with a thickness, measured parallel to the axis 28, equal to the distance separating the sides 33 and 26, so that this spring 60 acts as a cross piece, maintaining the side 58 at a distance from the side 26 such that the sides 57 and 42 are in mutual flush contact. In the direction of a distancing with respect to the axis 57, the sides 57 and 58 of the reel 15 connecting the side 56 of the latter to a side 51 revolving around the axis 157 and forming a winding groove for the cable 8, with a maximum diameter less than that of the side 40 reduced by twice the gap between the axes 28 and 157.

Projecting on its side 58 parallel to the axes 28 and 157, i.e., towards the side 26 of the base plate 20, the reel 15 has, in a solidary manner, a lug 62 connected with an end 63, radially outward with respect to the two axes 28 and 157, of the spring 60 which, moreover, has a second end 64, radially inward with reference to these axes, through which it is made fast with the protuberance 29 of the side 26 of the base plate 20. For this purpose, the spring 60 is bent towards the axis 28 at its end 64 to engage solidly in a slit 66 placed radially, with respect to the axis j28, in the side 30 of the protuberance 29, and it is bent at its end 63 in the direction of a distancing with respect to the axis 28 to engage with the lug 62 of the reel 15 at least radially, with reference to the two axes 28 and 157, such that a rotation of the reel 15 in a predetermined direction 66 with respect to the base plate 20—housing 34 group, around the axes 28 and 157, sufficiently close for both to be placed on the inside of the side 56 of the reel 15, causes tensioning of the spring 60 and causes the latter to tighten and thereby to cause a rotation of the reel 15 with respect to the base plate-housing group in the opposite direction 67 which will be defined as the windup direction for the cable 8 in the groove 61 of the reel 15.

Internally, i.e., through its side 56, the reel 15 has, upon relative sliding parallel to the axes 28 and 157 but without the possibility of relative rotation, notably with reference to the axis 157, a component 68 presenting in contact with the side 56, a side 69 which is also cylindrical for revolution around the axis 157 with a diameter more or less equal to that of the side 56 so as to ensure a mutual sliding contact, this side 69 presenting parallel to the axis 157 a length more or less equal to the distance separating the side 45 of the protuberance 43 of the side 42 of the housing 34 and the side 33 of the protuberance 29 of the side 26 of the base plate. The side 69 thus connects, parallel to the axis 157, two sides which are annular, planar, perpendicular to the axis 157, with a side 70, turned towards the side 33 of the protuberance 29 of the side 26 of the base plate 20 and towards this side 26, and a side 71 turned towards the side 42 of the housing 34. In the direction of a radial approach to the axis 157, the side 70 connects the side 69 to a side 72, also cylindrical, for revolution around the axis 157 towards which it is turned, this side 72 having a diameter less than that of the side 69 as well as that of the side 46 of the housing 34. In the same direction, the side 71 in turn connects the side 69 to a side 73 turned towards the axis 157 and provided with toothing which is complementary to that of the side 44 of the protuberance 43 of the side 42 of the housing 34, the toothing of the side 73 having, with reference to the axis 157, a working cylinder diameter greater than the working diameter of the cylinder for the toothing of the side 44, with reference to the axis 28. The side 73 thus connects the side 71 to a side 74 which is annular, planar, perpendicular to the axis 157 and which, turned in the same direction as the side 71 but in the opposite direction as side 70, connects the side 73 with the side 72 in the direction of a radial approach to the axis 157. Parallel to the axes 28 and 157, the side 73 of the component 68 and the side 44 of the protuberance 43 of the side 42 of the housing 34 are of more or less identical size, substantially equal to the difference between the distance separating the sides 45 of the protuberance 43 and 33 of the protuberance 29, on the one hand, and the distance separating the sides 74 and 70, on the other hand.

Thus, the distance between the axes 28 and 157 being maintained at half of the difference between the respective diameters of the cylinders for the toothing of sides 73 and 44, through the use of means which will be described, one can move the component 68 inside of the reel 15 parallel to the axes 157 and 28 such that its toothed side 73 is in contact with the toothed side 44 of the protuberance 43 of the side 42 of the housing 34, defining an epicycloidal reduction wheel gear towards the component 68 and irreversible after this point, is disengaged from the toothed side 44. In both of these positions as in any intermediate position, a mutual fastening of the component 68 and the reel 15 in rotation around their common axis 157 or the axis 28 is ensured by any appropriate means, and, for example, by two keys 75 and 76, arranged in grooves placed in a complementary manner, parallel to the axis 157, on one hand in the side 56 of the reel 15 (grooves 77 and 78) and on the other hand in the side 69 of the component 68 (grooves 79 and 80).

Such a translation movement, as well as a manual rotation of the component 68 and the reel 15 in the winding direction 57 with respect to the housing 34—base plate 20 group can be effected by action on a control button 81 which is mounted in rotation around the axis 28 with respect to the housing 34—base plate 20 group and covers the side 47 of the housing 34 and a zone of the side 49 of the housing in immediate proximity to the groove 50 connecting with this side 47.

For this purpose, the button 81 has a bottom wall 82 facing the side 47 of the housing 34 and bordered by a skirt 83, which presents, towards the axis 28, a cylindrical side 84 revolving around this axis with a diameter which is sufficiently close to that of the side 49 to establish a sliding contact between the sides 49 and 84 and to prevent, to the greatest extent possible, the entry of snow, mud or pebbles between the bottom wall of the button 81 and the bottom wall 48 of the housing 34. Towards the side 51 of the housing 34, the side 84 is delimited by an intersection with a side 85 which is annular, planar, rotating around the axis 28 to which it is perpendicular, this side 85 being turned towards the side 51 of the housing 34 and connecting the side 84, in the direction of a radial distancing with respect to the axis 28, with a padded side 86, in a general form for revolving around the axis 28 and turned in the direction of a distancing with respect to the former. This side 86 serves in the manual grip of the button 81 to cause its rotation around the axis 28 with respect to the housing 34—base plate 20 group. It connects the side 85, in the direction of a distancing with respect to the side 51 of the housing 34, to a planar side 87, perpendicular to the axis 28, which delimits the bottom wall 82 in the direction of a distancing with respect to the side 47 of the housing 34; towards this side 47, the bottom wall 82 is delimited by an annular planar side 88, revolving around the axis 28 to which it is perpendicular, the side 88 of which limits the side 84 in the direction of a distancing with respect to the side 51 of the housing 34 and connects this side 84 in the direction of a radial approach with respect to the axis 28, to a rod 89 fastened to the button 81 and forming a projection, following the axis 28, on the side 88 so as to enter the internal volume 53 of the housing 34—base plate 20 group. Advantageously, as illustrated, at the intersection of the side 88 with the rod 89 is placed, in the side 88, a groove 90 for revolving around the axis 28, the groove 90 of which constitutes a first support for an end coil of a conical-type compression spring, with close end coils, arranged around the rod 89 and in addition, pressing, with its other end coil, against the side 47 of the bottom wall 48 of the housing 34, around the intersection of this side 47 with the side 46, so as to elastically tighten the spring, to separate the side 88 from the bottom wall 82 of the button 81 with respect to the side 47 of the bottom wall 48 of the housing 34. The spring 91 however, allows a mutual contacting of the sides 88 and 47, by compressing within the groove 90 which is appropriately designed for this purpose.

At its intersection with the side 88 of the bottom wall 82 of the button 81 through the intermediary of the groove 90, the rod 89 presents a first section 92, delimited by a cylindrical side 93 revolving around the axis 28 with a diameter which is more or less identical to that of the side 46 so as to allow a mutual contact sliding between the sides 83 and 46. In the direction of a distancing with respect to the side 88, following the axis 28, this first section 92 is connected to a second section 94 of the rod 89, which is itself delimited by a cylindrical side 95 revolving around an axis which is shifted with respect to the axis but parallel to it and which defines the axis 157. The side 95 has a diameter less than that of the side 93 of an amount corresponding to twice the size of the gap between the axes 28 and 157, this diameter being in addition more or less equal to that of the side 72 of the component 68 so as to allow a mutual sliding contact between the sides 72 and 95. The side 95 is connected to the side 93 by a planar side 96, perpendicular to the two axes 28 and 157. In the direction of a distancing with respect to the side 88 parallel to the axes 28 and 157, the second section 94 of the rod 89 is connected to a third section 97 delimited on one hand by a cylindrical side 98 revolving around the axis 28 with a diameter less that that of the side 95 by an amount corresponding to twice the gap between the axes 28 and 157, the side 98 being connected to the side 95 by a planar side 99 perpendicular to the two axes 28 and 157, and on the other hand by an end side 100 perpendicular to the two axes 28 and 157 and of the same orientation as the side 88. It will be noted that the diameter of the side 98 of the third section 97 is less than that of the side 31 of the protuberance 29 of the base plate 20, such that the section 97 of the rod 89 can engage coaxially inside of this side 31 provided that there is a clearance filled by a sleeve 101. This sleeve has, respectively towards the axis 28 and in the direction of a radial distancing with respect to it, two cylindrical surfaces rotating around the axis 28, with one side 102 with a diameter more or less equal to that of the side 98 of the third section 97 of the rod 89 and a side 103 of a diameter more or less equal to that of the side 31 of the protuberance 29 of the base plate 20 to enter into sliding contact with the latter. Transversally with respect to the axis 28, the sleeve 101 is delimited by two annular planar sides, perpendicular to the axis 28, one (104) of which is placed in contact with the side 99 connecting the sides 98 and 95 of the rod 89, and the second of which (105) is placed coaxially at the end side 100 of the section 97 of the rod 89, the distance separating the sides 104 and 105 being more or less identical to the distance separating the sides 99 and 100 parallel to the axes 28 and 157. The sleeve tube 101 is connected with the rod 89 by any means, and for example, utilizing a screw 106 presenting a shaft 107 screwed into a hole 108 penetrating the side 100 of the rod 89 following the axis 28 and with a head 109 of diameter between the respective diameters of the sides 102 and 103 of the sleeve 101 to be applied simultaneously against the side 100 of the rod 89 and against the side 105 of the sleeve 101. It will be noted that the side 99 of the rod 89 offers only a localized support for the side 104 of the sleeve 101, which, in addition, defines, around the side of the rod 89, a perpendicular shouldering for the axis 28 and turned towards the side 96 (see FIG. 2). The length of the side 95 in parallel with the axes 28 and 156 is selected to be equal to the distance of parallel separation of these axes and the sides 74 and 70 of the component 68. This shouldering is utilized to fasten the component 68 with respect to the rod 89 on the parallel translation of the axes 28 and 157, while nonetheless allowing a possibility for relative rotation around the axis 157, the side 70 of the component 68 being pressed against the shouldering thus defined by the side 104 of the sleeve 101, whereas the side 74 of this component 68 is pressing against the side 96 of the rod 89. The side 96 of the rod 89 itself is placed at a distance from the side 88, measured in parallel with the axes 28 and 157, at least equal to the distance separating the sides 45 and 47 in parallel with these axes, increased by the difference between the parallel distance separating these axes and the sides 70 and 74 of the component 68 and the parallel distance separating from these axes the sides 45 and 33; finally, the length of the section 97 of the rod 89 measured between the sides 99 and 100 parallel to these axes, i.e., also the length separating the sides 104 and 105 of the sleeve tube 101 in parallel with these axes, is at least equal to this difference and, in addition, less than the distance separating the sides 33 and 25, reduced by the thickness of the head 109 of the screw 106 measured in parallel with the axes 28 and 157.

It will be noted in addition that the length of the side 84 measured in parallel with the axes 28 and 157, i.e., the distance separating the sides 88 and 85 parallel to these axes, is less than the distance separating the openings 54 and 55 of the side 47 of the housing 34 but greater than the sum of the length of the groove 60 measured in parallel with the axes 28 and 157 and the difference between the distance separating the side 96 and the side 88 and the distance separating the sides 45 and 47.

Thus, when no manual stress is applied to the button 86 in the direction of an approach of its bottom wall 82 with respect to the bottom wall 48 of the housing 34, the spring 91 elastically keeps these two walls a maximum distance apart, which maintains, through action of the screw head 109 on the side 105 of the sleeve, and through action of the its side 104 on the side 70 of the component 69, this component 68 stopped by its side 74 against the side 45 of the protuberance 43 of the bottom wall 48 of the housing 34, which signifies that the toothed rings defined respectively by the sides 73 of the component 68 and 44 of the protuberance 43 are in contact, defining a reducing epicycloidal wheel gear in one direction going from the button 81 to the component 68, and irreversible in the opposite direction. Manual rotation of the button 81 with respect to the housing 34—base plate 20 group, around the axis 28, thus causes a combined rotation of the component 68 and the reel 15. If, on the other hand, manual pressure is applied to the button 81 in the direction of an approach of its bottom wall 82 with respect to the bottom wall 48 of the housing 34 in parallel with the axes 28 and 157, until the sides 88 and 47 are in mutual contact and the spring 91 is lodged flush, compressed at a maximum, inside the groove 90, the contact between the toothed side 73 of the component 68 and the toothed side 44 of the protuberance 43 ceases and the reel 15 is freed from any connection in rotation with the button 81 and subject exclusively to the action of the spring 60 or to the potential action of a traction applied to the cable 8 in the direction of an unwinding.

Putting on a boot 1 equipped with the means 19 which were just described can thus be effected in the following manner, with reference to FIGS. 4 and 5.

It will be assumed that the collar 4 and the cap 5 of the upper 3 initially are in the closed position, illustrated in FIG. 4, and that the cable 8 is under tension between the hook 11, for example, and the reel 15 on which it is partially wound in the direction 67. The irreversibility of the wheel gear constituted by the toothed sides 73 and 44 then kept in mutual engagement due to the action of the spring 91 between the housing 34 and the button 81 maintains this tension. The recall spring 60 is then advantageously tightened, and able to tighten further between the groove 64 of the protuberance 298 and the cog 62 of the pulley 15 upon the slightest rotation of it in the unwinding direction of the cable 8 with respect to the housing 34—base plate 20 group, around the axes 157 and 28.

The user then presses the button 81 to bring the sides 88 and 47 into contact, which breaks the engagement between the toothed surfaces 44 and 73, i.e., it frees the reel 15 for rotation around the axes 157 and 28 with respect to the housing 34—base plate 20 group. Simultaneously, the user applies manual traction towards the rear, on the upper zone 17 of the cap 5, to lead it into the open position shown in broken lines in FIG. 4 and in solid lines in FIG. 5. During this phase, the length of the cable 8 between its end 9 and the winding reel 15 must increase, and the cable 8 retained at its end by the hook 11, slides in the tamisat 18 and unwinds with respect to the reel 15, which turns in the direction 66 around the axis 157 on the second section 94 of the rod 89 of the button 86, i.e., also, taking into account the low value of the gap between the axes 157 and 28, around the latter axis 28, with respect to the housing 34—base plate 20 group, which results in the application of pressure on the recall spring 60; the button 81 remains immobile upon rotation during this opening phase of the boot upper.

When the open position of the upper is reached, as illustrated in FIG. 5, the user releases the presssure on the button 81, so that the spring 91 resets this button, with respect to the housing 34—base plate 20 group, to the initial position in which, notably, the toothed surfaces 44 and 73 are in mutual engagement. Taking into account the irreversibility of the wheel gear constituted by the toothed surfaces 44 and 73, the means 19 are then blocked against a winding of the cable 8 on the reel 15; in other words, this irreversibility opposes the action of the spring 60 tending to cause rewinding; consequently, the opening position constitutes a stable position and the user may freely put on the boot 1.

Once the boot is put on, the user again presses on the button 81 to re-establish contact between the toothed surfaces 48 and 47, again disengaging toothed surfaces 44 and 73; there is then no longer anything countering the action of the spring 60, which elastically causes a rotation of the reel 15 in the winding direction 67, around the axis 157 with respect to the second section 94 of the rod 89 of the button, kept immobile on rotation, i.e., also around the axis 28 with respect to the housing 34—base plate 20 group.

This winding produces on the cable 8, still retained at its end 9, a traction which causes a movement of the cap 5 from its open position towards its closed position, but this movement is interrupted on its own as soon as the cap 5 arrives in contact with the base of the user's leg.

The latter then releases pressure on the button 81, so that the spring 91 brings the toothed surfaces 44 and 73 back to a position of mutual engagement. Due to the irreversibility of the gearing constituted by these surfaces, the blocking of the cable in the standby position is ensured. Then, by turning the button 81 in the direction 67 with respect to the housing 34—base plate 20 group, around the axis 28, the user may cause a stepped-down rotation of the reel 15 in the same direction around the axes 157 and 28, with respect to the housing 34—base plate 20 group, to adjust the pressure applied by the collar 4 and the cap 5 to the base of the leg; possibly, he can reduce this tightness by turning the button 81 in the opposite direction, with respect to the housing 34—base plate 20 group.

The boot can next be taken off by again pressing the button in the direction of a mutual disengagement of the toothed surfaces 44 and 73, and a manual action on the upper area 17 of the cap 5 to bring it back to the open position, which causes a traction on the cable 8 and its unwinding with respect to the reel 15, as described above with reference to FIG. 4.

Of course, the structure which has just been described constitutes only one embodiment. Numerous variations are possible without departing from the scope of the invention.

Figure 7:
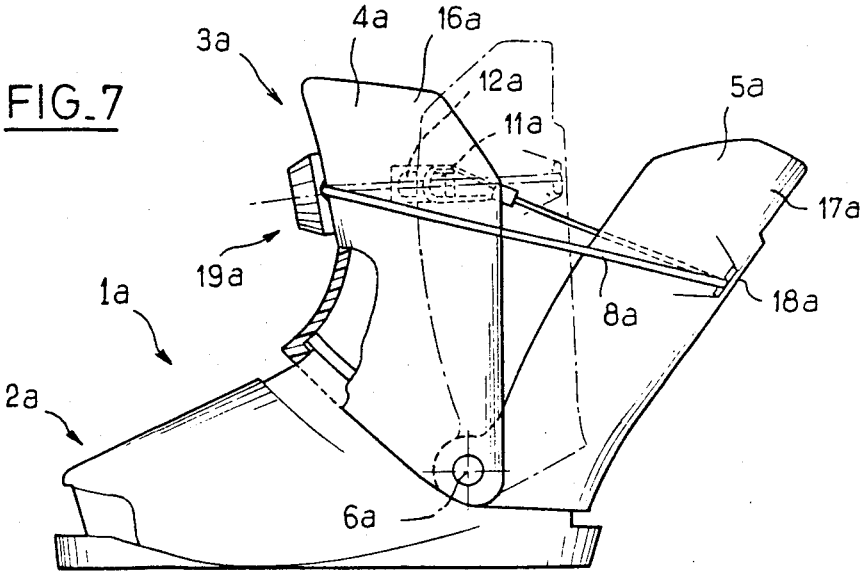
FIG. 7 shows a second embodiment of the assembly of the locking means which activate the means of traction on the flexible connection illustrated in FIGS. 1 to 3, the upper elements occupying their open position.

For example, illustrated in FIG. 7 is a variation of the positioning of the unlockable locking means of the boot upper.

In the case of this variant, one finds boot 1*a*, in all respects similar to boot 1 illustrated in FIGS. 4 and 5, and notably including a shell 2*a* and an upper 3*a* in all respects similar respectively to the shell 2 and the upper. Specifically, the upper 3*a* comprises a collar 4*a* which is identical to the collar 4 and a cap 5*a* which is identical to the cap 5, arranged mutually around an axis 6*a* in a manner identical to the axis 6, such that the cap 5*a* may occupy, with respect to the collar 4*a*, fixed with respect to the shell 2*a*, an open position illustrated in solid lines and a closed position illustrated in broken lines, as was described above with respect to the cap 5 and the collar 4.

A cable 8*a*, in all respects similar to the cable 8, is anchored at one of its ends to one (11*a*) of the two hooks 12*a* in all respects similar to the hooks 11 and 12 described above, and arranged like them in an upper lateral zone of the collar 4*a*. If one follows the cable 8*a* from this end anchored on the collar 4*a*, this cable 8*a* next bypasses, through the rear, an upper zone 17*a* of the cap 5*a*, on which it is guided by a tamisat 18*a* in all respects similar to the tamisat 18; it then runs along the upper lateral zone 16*a* of the collar 4*a* opposite the latter's zone bearing the hooks 11*a*, 12*a*, to come into contact on its second end with a winding spool for the means 19*a*, in all respects similar to the means 19, with the sole exception that, instead of being placed in the zone 16*a*, they are supported by an upper front zone of the collar 4*a*. Putting on this boot and taking it off are effected as described above with reference to boot 1, requiring utilization of the means 19*a* completely identical to that of the means 19.

Figure 8:
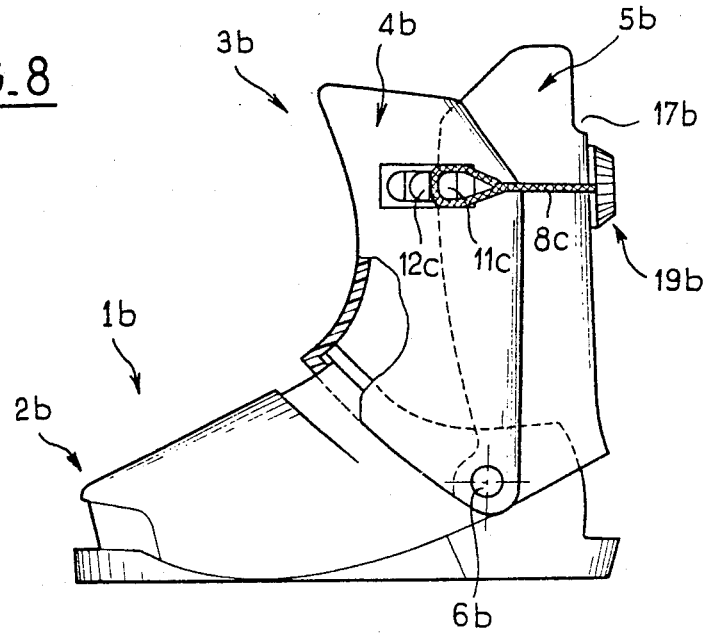
FIG. 8 illustrates a third embodiment of the assembly of the releasable locking means which activate the means of traction on the flexible cable in FIGS. 1 to 3, in a variation implementing the two flexible cable.
Figure 9:
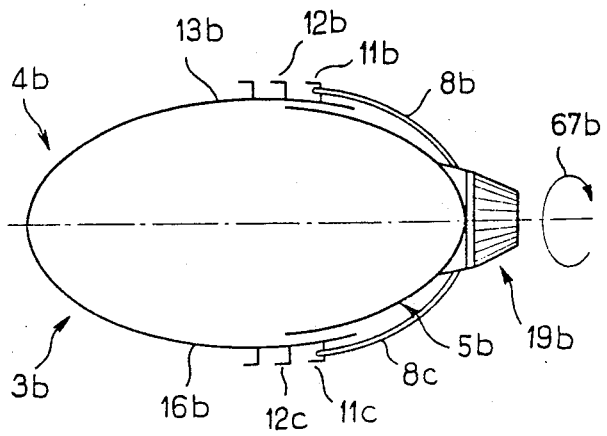
FIGS. 9 and 10 illustrate the assembly details for the flexible cables.
Figure 10:
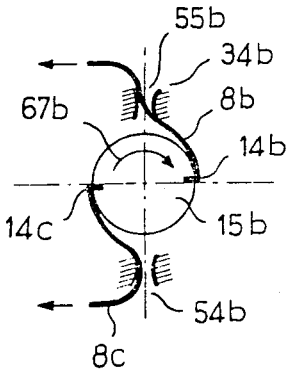

FIGS. 8 to 10 pertain to another embodiment implementing the means 19*b* in all respects similar to the means 19, except that each of the openings 54*b* and 55*b* of the housing 34*b*, corresponding respectively to openings 54 and 55 of the housing 34, receives a respective cable 8*b*, 8*c*. Each of these cables 8*b*, 8*c* has a respective end 14*b*, 14*c*, connected to the winding reel 15*b*, corresponding to the reel 15, such that a rotation of this spool 15*b* in a predetermined direction 67*b* with respect to the housing 34*b* translates into a winding up of the two cables 8*b* and 8*c* on this spool, and a rotation in the opposite direction is accompanied by unwinding of the two cables.

In the case of this variation, which may be utilized jointly with a boot 1*b* similar in all respects to the boot 1*a* and including a shell 2*b* with an upper 3*b* formed of a collar 4*b* connected to the shell and a cap 5*b* arranged around an axis 6*b* with respect to the collar 4*b* in a manner which is completely similar to that which was described with reference to FIGS. 4 and 5, the means 19 are brought towards the rear of the rod through the upper zone 17*b* of the cap 5*b*, such that the cables 8*b* and 8*c* are placed approximately according to a same horizontal plane respectively on both sides of the cap so as to come into contact, through their end opposite that which is fastened to the spool 15*b*, respectively on one of the hooks such as 11*b*, 12*b*, solidly held by an upper lateral zone 13*b* of the collar 4*b*, and on one of the hooks such as 11*c*, 12*c*, supported solidly by the opposite upper lateral zone 16*b* of the collar 4*b*. Those skilled in the art will immediately understand that the operation of a boot 1*b* thus equipped is completely analogous to that of the boot 1 which was described with reference to FIGS. 4 and 5, the operation of the means 19*b* being in all respects similar to that of the means 19.

In each of the embodiments which have been described, one may add to the means 19, 19*a*, 19*b* a further device which is activated manually, allowing, when desired, the immobilization of the windup spool in any desired position or to freely allow an operation according to the mode which has been described. The design and construction of such a device are well within the competency of one of ordinary skill in the art.

Naturally, any combined variants of the respective embodiments of FIGS. 4 to 6, 7 and 8 to 10 may also be chosen without departing from the framework of the invention. For example, the upper elements, namely the cap or the collar, on which the single cable 8 is anchored or on which the two cables are anchored, and these elements which bear the means of traction on this cable or on these cables, may be chosen differently as soon as cooperation is established in the direction of the closing of the upper during the windup of the cable or cables, with unwinding of the cable or cables during the passage into the open position of the upper.

Variants of the invention may also apply to the mode of assembly for the means of traction on the cable or cables.

Figure 11:
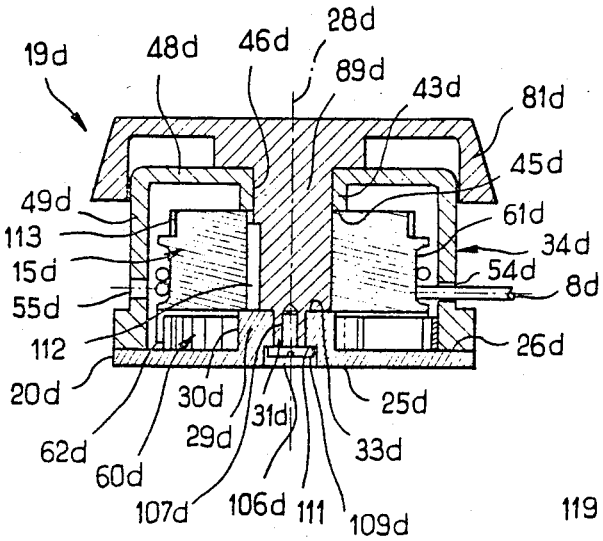
FIG. 11 illustrates, in a view analogous to that in FIG. 2, a second mode for the assembly of the means of traction on the flexible cable.
Figure 12:
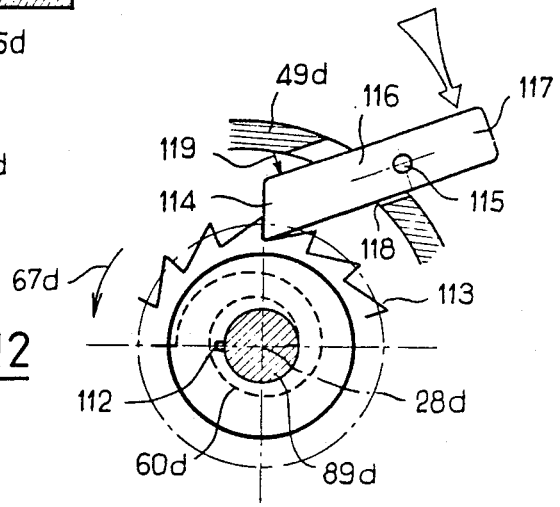
FIG. 12 illustrates a part of this second assembly mode in a view corresponding to that in FIG. 3.
Figure 13:
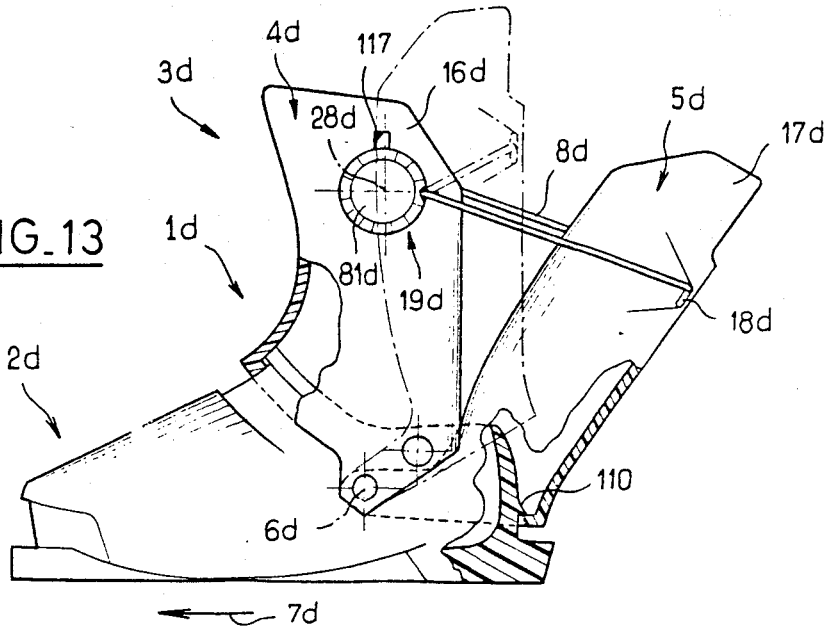
FIG. 13 illustrates an assembly example for the releasable locking means which implement this second assembly mode for the means of traction on the flexible cable, the upper elements being assumed to be in open position.

Thus, FIGS. 11 to 13 show a simplified version of these means, which can be utilized, but not exclusively, with a boot of the type described in French Patent Application No. 83 02437, including the proper means allowing the open position of the upper to be made a stable position.

More precisely, FIG. 13 shows a boot 1*d* with, just as described with reference to FIGS. 4 and 5, a shell 2*d* designed to accommodate the foot, and, toward the upper part, bearing an upper 3*d* formed of a collar 4*d* fixed with respect to the shell 2*d* and a cap 5*d* which itself is pivotally mounted, around an axis 6*d* placed horizontally, transverse with respect to the forward movement direction 7*d*, on the shell 2*d* and the collar 4*d*, at the bottom of the upper. The cap 5*d* can thus occupy a closed position, illustrated in broken lines, and an open position, illustrated in solid lines. The boot 1*d* differs essentially from the boot 1 described with reference to FIGS. 4 and 5 by the fact that, in this open position, the cap 5*d* locks elastically, in an unlockable manner, on a tappet 110 brought towards the rear by the shell 2*d*, so that the open position of the upper constitutes a stable position because of the fact that the elements form an integral part of the boot.

It will be noted that the different cable assemblies and traction means described with reference to the preceding figures may also be utilized on this type of boot; equally, the assembly which will be described can also be utilized in the case of boots of the type illustrated in the preceding figures.

As described with respect to FIGS. 4 and 5, on an upper lateral zone of the collar 4*d* is anchored, for example by use of hooks (not shown) one end of the cable 8*d*, the other end of which being attached to a winding reel 15*d* which is a part of the means of traction 19*d* on the cable 8*d*, carried by the upper lateral zone 16*d* of the collar 4*d* opposite its aforementioned upper lateral zone. Between these two ends, the cable 8*d* bypasses through the rear of the cap 5*d*, which has a guidance tamisat 18*d* analogous in all respect to the tamisats 18 and 18*a* described above. This assembly is completely comparable to that which was described with reference to FIGS. 4 and 5, with the exception of the presence of the tappet 110 on the shell 2*d* and the solid structure of the means of traction 19*d* on the cable 8*d*, which will presently be described more especially with reference to FIGS. 11 and 12.

Like the means 19 described with reference to FIGS. 1 to 3, the means 19*d* include a base plate 20*d* which can be attached flat, by a side 25*d*, against the collar 4*d* in the cone 16*d* of the former, said base plate having, opposite its side 25, a side 26*d* covered by a housing 34*d* at all points comparable with the housing 34, notably including a bottom wall 48*d* facing the side 26*d*, at a distance, and a lateral wall 49*d* connected to the bottom wall 48*d* and connecting this to the side 26*d* of the base plate 20*d*, to which it is connected, for example, by screws.

The base plate 20*d* and the housing 34*d* have a general form rotating around an axis 28*d* which is perpendicular to the sides 25*d* and 26*d*, centrally with respect to these.

Like the side 26 of the base plate 20, the side 26*d* of the base plate 20*d* has a central protuberance 29*d* with a cylindrical side 30*d* revolving around the axis 28*d* and turned in the direction of a radial distancing with respect to it, within the housing 34*d*. This side 30*d* is surrounded by a spiral spring 60*d* in all respects comparable to the spring 60, and is connected, with respect to a relative rotation around the axis 28*d*, both to the protuberance 29*d* and to a cog 62*d* carried in a solidary manner by the winding reel 15*d*. The latter is arranged within the housing 34*d*—base plate 20 group, and held against a transitional movement with respect to this group along the axis 28*d* by any appropriate means, and, for example, by a stop, on one hand, against a side 33*d*, planar, perpendicular to the axis 28*d*, delimiting the protuberance 29*d* towards the bottom wall 48*d* of the housing 34*d*, and, on the other hand, by a side 45*d*, also planar and perpendicular to the axis 28*d*, delimiting towards the base plate 20*d*, a protuberance 43*d* presented by the bottom wall 48*d* of the housing 34*d* towards the base plate 20. The cog 62*d* forms, with respect to the reel 15*d*, a projection which is parallel to the axis 28*d* towards the side 26*d* of the base plate 20*d*, between the side 30*d* of the protuberance 29*d* and the wall 49*d* of the housing 34*d*. It will be noted that, in this mode of assembly for the means 19*d* of traction on the cable 8*d*, the winding reel 15*d* has an annular form revolving around the axis 28*d*.

the protuberances 43*d* and 29*d* also have an annular form revolving around the axis 28*d*, and are perforated along this axis with respective holes also crossing respectively the base plate 20*d* and the bottom wall 48*d* of the housing 34*d*, on both sides. The hole of the protuberance 43*d* is thus delimited by a cylindrical side 46*d* revolving around the axis 28*d*, and that of the protuberance 29*d* by a side 31*d* which is also cylindrical, revolving around the axis 28*d* and having two sections connected by a planar annular side, revolving around the axis 28*d*, with a section contiguous to the side 33*d* and having a relatively smaller diameter and a section contiguous to the side 25*d* and which presents a relatively larger diameter; the connective shouldering between these two sections is shown by reference 111 in FIG. 11.

The sides 46*d* and 31*d* thus serve for rotational guidance, around the axis 28*d* with respect to the housing 34*d*—base plate 20*d* group, of a rod 89*d* for a movement button 81*d* covering the bottom wall 48*d* of the housing 34*d* and its wall zone 49*d*adjacent to this wall 48*d*, but without permitting relative translation following the axis 28*d*, contrary to the case of the button 81 for the means 19 described with reference to FIGS. 1 to 3. For this purpose, for example, the button 81*d* presses against the wall 48*d* in the direction of approach with respect to the latter, and a screw 106*d* is screwed by its shaft 107*d* in an axial hole in the rod 89*d*, and presses with a head 109*d* against the shouldering 111, the rod 89*d* connecting the bottom wall 48*d* of the housing 34*d* to the base plate 20*d* while crossing the reel 15*d* on both sides, with which it is connected, notably on rotation around the axis 28*d*, by any means and, for example, by keying, as indicated at 112.

Figure 1:
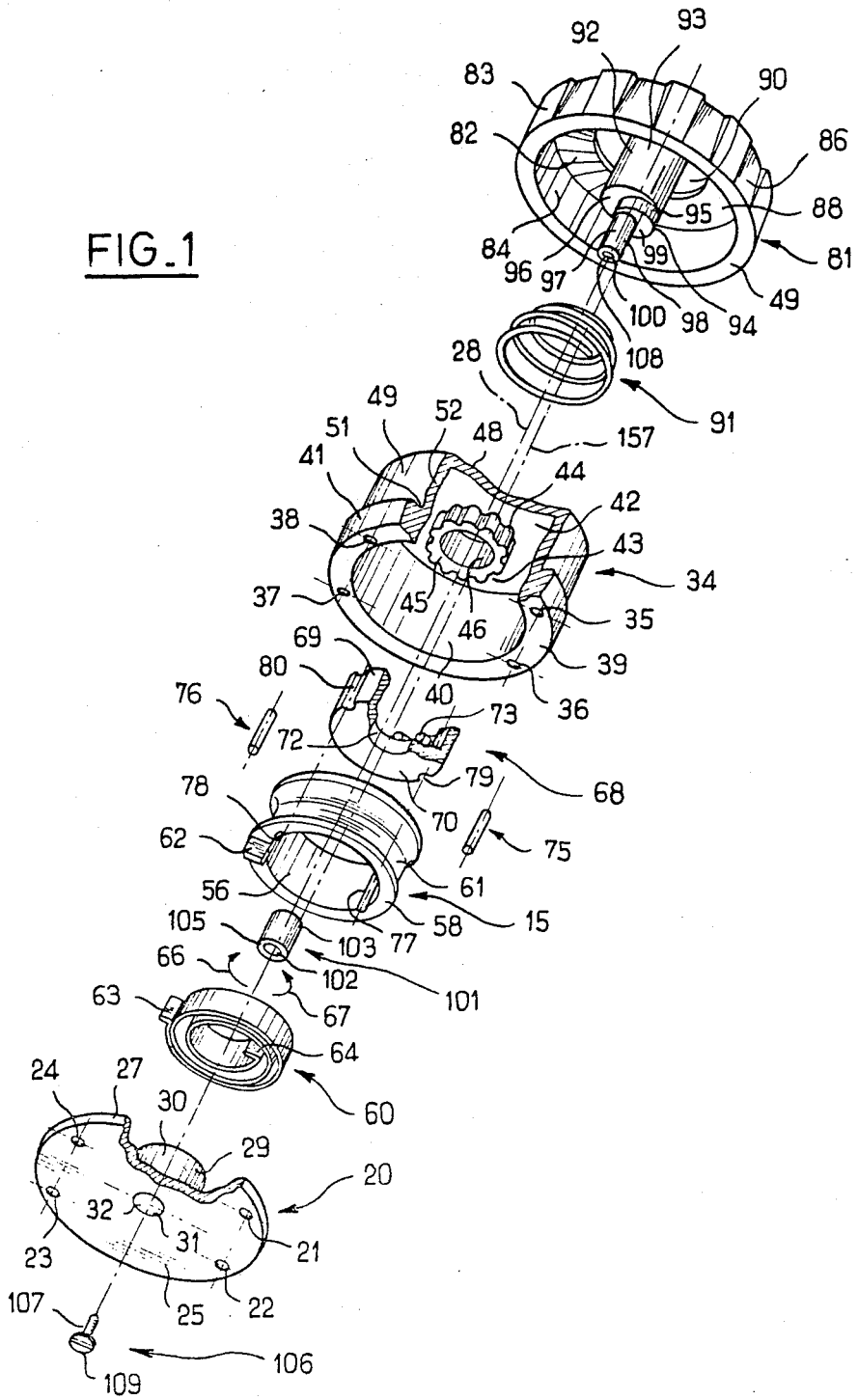
FIGS. 1 to 3 illustrate a first type of traction means on the flexible cable, conforming to the invention, respectively in an exploded perspective view, a section view, along line II—II in FIG. 3, and a section view along line III—III in FIG. 2.
Figure 2:
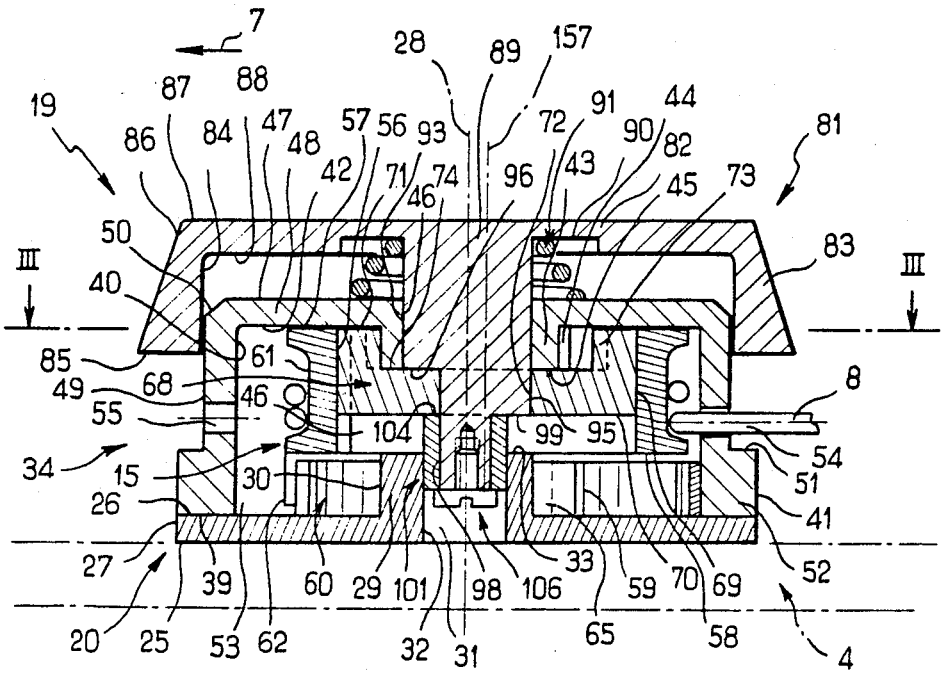
Figure 3:
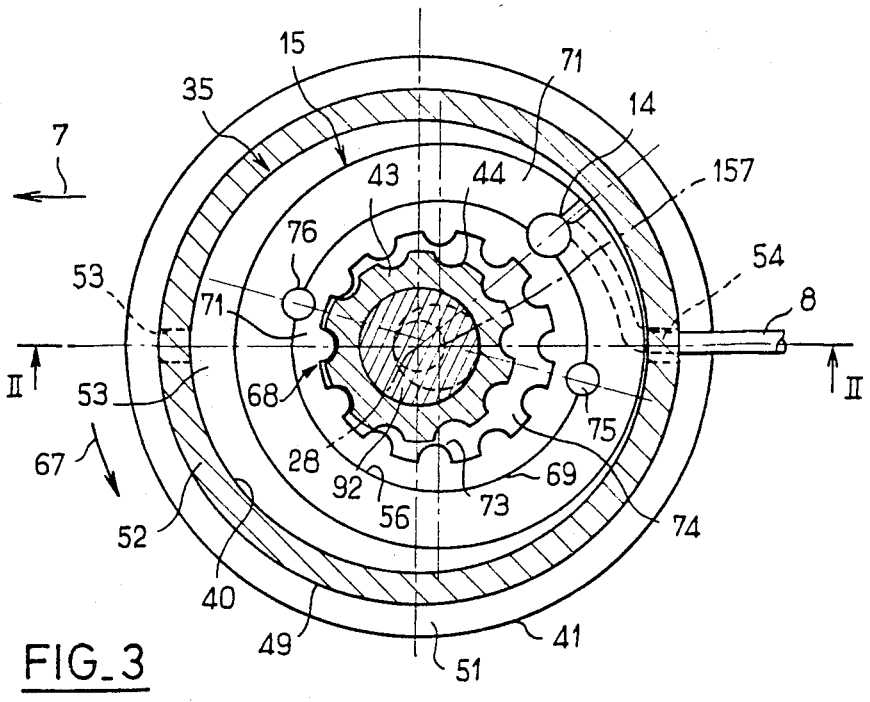

In the direction of a distancing with respect to the axis 28*d*, reel 15*d* has a cable winding groove 61*d*, in front of which the housing 34*d* wall 49*d* has passage openings for cables 54*d* and 55*d* at all points comparable to openings 54 and 55 provided in FIGS. 1 to 3. In addition, on the groove 61*d* is juxtaposed, opposite the cog 62*d*, following the direction of the axis 28*d*, a toothing 113 which is connected with the reel 15*d* and which defines a ratchet wheel which is coordinated with a catch 114, pivotably mounted inside the housing 34*d*, around an axis 115, which is fixed with respect to the wall 49 of the latter and with respect to the catch 114; this axis 115 is, in addition, parallel to the axis 28*d*. The catch 114 is comprised of an end zone of a lever 116 passing through the wall 49*d* via an opening 118 in the latter in an intermediate area of the lever, in which the articulation axis 115 is located, and, in addition, having, outside the housing 34*d*, a second end 116 on which the user may act manually to engage or disengage the catch 114 with respect to the toothing 113. preferably, means shown schematically by an arrow 119, and advantageously comprised of a spring and, for example, by a spring and pin arranged around the axis 115, calling upon the catch 114 in the direction of an engagement with the toothing 113, the engagement alone requiring a manual intervention on the end area 117 of the lever 116 and the cessation of this action automatically causing renewed engagement of the catch 114 in the toothing 113.

The toothing 113 and the catch 114 are designed so that, when they are in manual contact, they counter a rotation of the reel 15*d* in the direction opposite to a direction 67*d* corresponding to a winding up of the cable 8*d* on the reel 15*d*, while, on the other hand, freeing the rotation in the direction 67*d*, whether this rotation is initiated by manual action on the button 81*d*, or caused by the spring 60*d*, which acts elastically on the reel 15 in the windup direction 67*d*.

When the cap 5*d* occupies the closed limit position, illustrated in broken lines in FIG. 13, the cable 8*d* connected to the collar on its end opposite to the end connected to the winding reel 15*d* is wound up as much as possible on the latter and the spring 60*d* is preferably tightened, but additional tension can be applied by the slightest rotation of the reel 15*d* in the direction opposite to the windup direction 67*d*; the catch 114 itself is taken with the toothing 113.

To cause passage into open position, illustrated in solid lines in FIG. 13, the user applies, on the end 116 of the lever 116, a push in the direction of disengagement of the catch 114 with respect to the toothing 113. Then, while holding this action, he moves towards the rear, with respect to the collar 4*d*, the upper end zone 17*d* of the cap 5*d* until the latter comes into contact with the tappet 110, which stops it in the open position. During this movement, the cable 8*d* unwinds from the reel 15*d*, turning in the opposite direction from the direction 67*d* around the axis 28*d* with respect to the housing 34*d*—base plate 20*d* group, and tension is applied to the spring 60*d*.

From the time of the engagement of cap 5*d* on the tappet 110, the user may release the lever 116 which resumes its catch 114 engagement position in the toothing 113; equally, the user may release the upper end zone 17*d* of the cap 5*d*.

The user then puts on the boot and releases the cap 5*d* from the tappet 110; the spring 60 then causes pivoting of the cap 5*d* towards the closed position, around the axis 6*d*, by rotation of the reel 15*d* in the windup direction 67*d* and traction on the cable 8*d*, without resistance to such a movement from the catch 114—toothing 113 group.

When the cap 5*d* arrives in the position of pressing against the skier's leg, this movement stops, but the user, by acting on the button 81*d* in the direction 67*d*, can pursue the winding of the cable 8*d* to apply a determined traction to it, and to apply the cap 5*d* under a predetermined pressure against the base of the leg.

Another opening of the boot upper 3*d* is effected by again disengaging the catch 114 of the toothing 113 and by pushing back the upper end area 17*d* of the cap 5*d* towards the rear until the cap 5*d* comes into contact with the tappet 110, as described above.

We claim:

1. In a downhill ski boot, of the type which includes two rigid elements (4, 5) forming a front collar element (4) and a rear cap element (5), mutually arranged in a lower zone of an upper (3) to permit the changing between a relative open (3) position and a relative closed (3) position, a notably, to allow a position of variable pressure of these two elements (4, 5) against the skier's leg to be occupied, this position being intermediate between said open and closed positions;

releasable locking means (8, 19), to retain said elements (4, 5) in position pressing against the leg and to allow, when desired, their passage into open (3) position, said locking means (8, 19) having, for this purpose, at least one flexible cable (8) which is substantially inextensible, in functional connection with at least a first of said elements (4, 5) of said upper in an upper zone thereof and means of traction (19) on said flexible cable (8), carried by the second of said elements (4, 5) of said upper (3), the improvement in which said traction means (19) on said flexible cable (8) comprises (a) a reel (15) for winding said flexible cable (8), a zone (14) of which is connected to a zone of said reel (15);

(b) devices (20, 34, 89) carried by said second element (3) for defining at least one rotational axis (28, 157) of said reel (15) with respect to said second element (3);

(c) means (60) of elastic solicitation for said reel (15) in a predetermined direction (67) of rotation around said rotational axis (28, 157), corresponding to a windup of said flexible cable (8), to elastically solicit said elements (4, 5) towards the closed upper (3) position;

(d) means (81) for manual pulling of said reel in said direction (67), to allow an additional windup of said flexible cable on said reel (15) when said upper (3) elements (4, 5) occupy a position exerting pressure against the skier's leg; and (e) means (44, 73, 113, 114) for temporary immobilization of said reel (15) in rotation in a direction opposite to said predetermined direction (67).

2. The combination according to claim 1, comprising means (44, 73, 110) for temporarily opposing the action of said means (60) of elastic solicitation on said reel (15).

3. The combination according to claim 1 or 2, wherein said flexible cable (8) further has a zone (9) connected with said second element, and which bypasses said first element opposite said second element between its zones (14, 8) which are respectively connected to said reel (15) and said second element.

4. The combination according to claim 3, wherein said flexible cable (8) is single.

5. The combination according to claim 3, wherein said first element comprises guidance means (18) for said flexible cable (8) in sliding.

6. The combination according to claim 1 or 2, wherein said flexible cable (8) further comprises a zone connected with said first element.

7. The combination according to claim 6, comprising two substantially inextensible flexible cables (8) each having a zone (14) connected to said reel (15) and a zone connected with said first element, and which are respectively placed on both sides of said upper (3).

8. The combination according to claim 1 or 2, wherein said means (60) of elastic solicitation for said reel (15) includes a spiral spring (60) placed around said axis (28, 157) and having two ends functionally connected, respectively, with said second (3) element and said reel (15).

9. The combination according to claim 1 or 2, wherein said means (44, 73, 113, 114) for temporary immobilization of said reel (15) on rotation in the opposite direction of said predetermined direction (67) includes a ratchet wheel (113) connected to said reel (15) in rotation, a catch (114) movably mounted with respect to said second element and elastically (119) solicited in the direction of engagement with said ratchet wheel (113), and means (117) for moving said catch (114) in the direction of disengagement with respect to said ratchet wheel (113).

10. The combination according to claim 9, wherein said means (81) for the manual movement of said reel (15) includes a control button (81) which is directly connected to said reel (15).

11. The combination according to claim 1 or 2, wherein said means (81) for manual pulling of said reel (15) includes a control button (81), means (46, 92, 31, 98, 101) defining a rotational axis (28) for said button (81) with respect to said second element (3), said axis (28) being fixed with respect to said button (81) and said second element (3), means (72, 81) defining a rotational axis (157) for said reel (15) with respect to said button (81), the last mentioned rotational axis (157) being fixed with respect to said reel (15) and said button (81) and being located parallel, off center, with respect to said rotational axis (28) of said button (81) with respect to said second element, a toothed ring (44) around the rotational axis (28) of said button (81) with respect to said second element and carried in a solidary manner, at least on rotation around this axis (28), by said second element, a toothed ring (73) around said rotational axis (157) of said reel (15) with respect to said button (81) and held in a sokidary manner at least upon rotation around this axis (157), by said reel (15), said rings (44 and 73) defining an epicycloidal step-down gear in the direction of a rotation transmission from said button (81) to said reel (15) and which is irreversible, and means (81) for placing said rings (44, 73) selectively into and out of mutual contact.

12. The combination according to claim 11, comprising (a) means (42, 60) for immobilizing said reel 915) against translation parallel to said axes (28, 157), with respect to said second element;

(b) means (96, 101, 109) for immobilizing during sliding movement parallel to said axes (28, 157) with respect to said second element, of said ring (44), connected to the latter element on rotation around the rotational axis (28) of said button (81) with respect to said second element;

(c) means for guidance, on translation parallel to said axes (28, 157) with respect to said reel (15), of said ring (73) connected to the latter on rotation around said rotational axis (157) of said reel (15) with respect to said button (81);

(d) means of mutual connection, against relative sliding movement parallel to said axes (28, 157), of said button (81) and of said ring (73) connected to said reel (15) on rotation around said rotational axis (157) of said reel with respect to said button (81);

(e) means (46, 93, 31, 101) of guidance for said button (81) in sliding with respect to said second element parallel to said axis (28, 157), with travel sufficient to place said rings (44, 73) selectively into and out of mutual contact; and (f) means (91) for elastic solicitation of the button (81) towards a position corresponding to the position of mutual contact of said rings (44, 73).

* * * * *